United States Patent [19]

Kepple

[11] 4,332,399

[45] Jun. 1, 1982

[54] SKI POLE

[76] Inventor: Wilson E. Kepple, 121 15th St., New Florence, Pa.

[21] Appl. No.: 167,112

[22] Filed: Jul. 9, 1980

[51] Int. Cl.[3] ..... A63C 11/22

[52] U.S. Cl. ..... 280/819; 135/65; 280/821; 403/229

[58] Field of Search ..... 280/817, 820, 821, 822, 280/823, 816, 809; 403/229; 248/160; 135/65, 66

[56] References Cited

U.S. PATENT DOCUMENTS

| | | | |
|---|---|---|---|
| 637,668 | 11/1899 | Rison | 403/229 |
| 1,388,719 | 8/1921 | Johnston | 248/160 X |
| 2,474,690 | 6/1949 | Robinson et al. | 403/229 |
| 3,524,324 | 8/1970 | Miklos | 403/229 X |

FOREIGN PATENT DOCUMENTS

| | | | |
|---|---|---|---|
| 2558940 | 7/1977 | Fed. Rep. of Germany | 280/819 |
| 598842 | 5/1978 | Switzerland | 280/823 |

*Primary Examiner*—Joseph F. Peters, Jr.
*Assistant Examiner*—Milton L. Smith
*Attorney, Agent, or Firm*—William J. Ruano

[57] ABSTRACT

A ski pole having a detachable coil spring disposed substantially centrally whereby a top portion and bottom portion of the ski pole may be detachably connected to the ends of the coil spring. The coil spring is of such stiffness as not to flex during normal operation of the pole during skiing. However, on application of abnormal bending force to the pole, the coil spring will flex sufficiently to prevent permanent bending or breaking of the pole. The handle of the ski pole may also be detachably secured to one end of a stiff coil spring, the opposite end of which coil spring is detachably secured to the top end of the ski pole so that the spring will not flex during normal operation but will flex upon abnormal bending applied to the handle to prevent hand injury to the skier.

4 Claims, 2 Drawing Figures

SKI POLE

This invention relates to a ski pole construction to prevent or minimize the possibility of bending or breakage of the ski pole or hand injury from applying abnormal bending forces.

An outstanding disadvantage of a ski pole is that there is a great tendency of bending or breakage of the pole if the skier falls on the pole or possible hand injury if the hand does not release from the grip when the skier falls. Upon such bending or breakage, the entire pole is useless or difficult to repair. Considerable expense is involved for a replacement by a new pole,—such inconvenience and expense being aggravated since the skier has to leave the slope and miss valuable skiing time to get the pole replaced or repaired.

An object of my invention is to provide a novel ski pole which is very stiff during normal skiing operations, threfore providing very rigid support to the skier but which will flex laterally upon application of abnormal bending forces thereto. (Such as when skier falls on pole during an accident)

A more specific object of the invention is to provide a ski pole with springs at the handle portion and at an intermediate portion that will flex only on abnormal application of bending forces.

Figure 1:
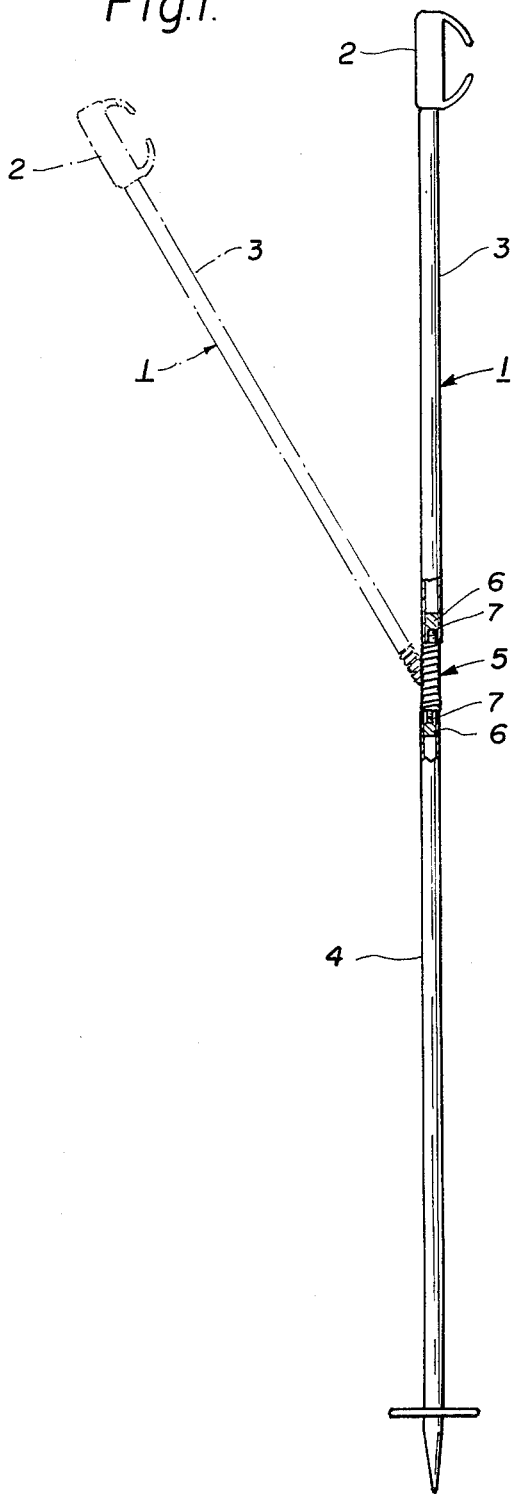
Figure 2:
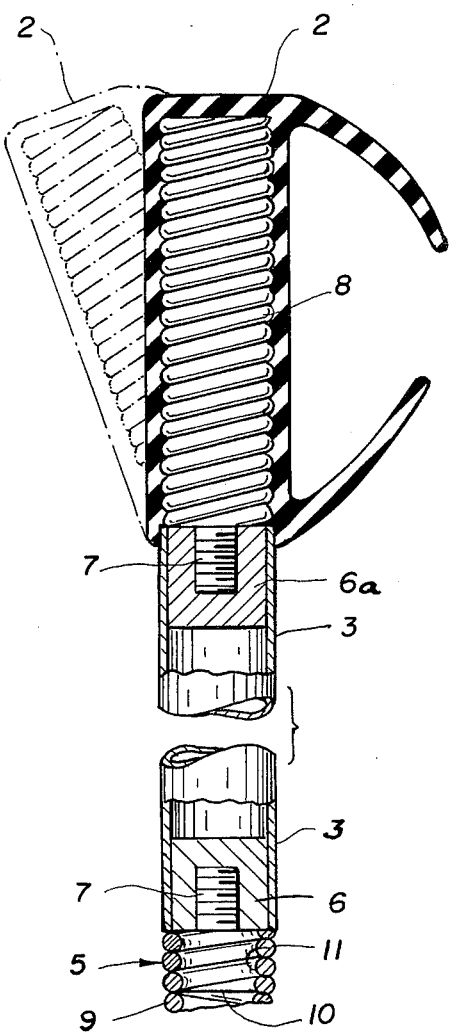

Other objects and advantages of the invention will become more apparent from a study of the following description taken with the accompanying drawing wherein;

FIG. 1 is an elevational view of the ski pole involving the principles of the present invention; and FIG. 2 shows a spring and detachable joint applied to the handle.

Referring more particularly to FIGS. 1 and 2 of the drawing, numeral 1 generally shows a ski pole. The pole comprises a top portion 3 and a bottom portion 4, which portions are detachably secured by any suitable means, to the opposite ends of a stiff helical coil 5. For example, the lower part of top portion 13 of the pole may have a detachably secured terminal section 10 having an integral narrow threaded shank 7 which may be screwed into a internally threaded shaft section 6 integrally secured to the lower part of top portion 3. Likewise, the top end of bottom portion 4 of the pole may have a similar outwardly threaded shank 7 of reduced diameter screw threaded into an internally threaded shaft section 6 integrally secured to the lower end of bottom portion 4. The handle 2 and pole grip are rigidly attached to top portion 3.

Alternatively, threaded shanks 7 may be eliminated and replaced by solid, smooth cylinders held in place by dowel pins (not shown) driven diametrically across through the cylinders, which dowel pins can be easily removed by hammering them outwardly. Similarly, the top end of pole portion 3 may be formed by providing a smooth solid cylindrical projection of reduced diameter fitting into shaft section **6*a*** and held thereto by a diametrical dowel pin (not shown).

It should be particularly noted that spring 5 must be very stiff and resist compression by downward push of the handle 2 during normal skiing operations or lateral forces on handle 2 during normal skiing. For increased stiffness, two concentric springs may be used with interconnected corresponding ends (not shown). Only upon application of abnormal bending forces applied by handle 2 will spring 5 flex or bend laterally so as to prevent bending or breakage of the pole (see dash and dot outline).

It should be noted that making the top portion or any portion of the ski pole itself flexible will not accomplish the principles of the present invention because the necessary rigidity of the pole would be lost. In short, the yieldability of the pole must be confined to very short lengths thereof.

I found that another critical point where deflection is important is in the handle or grip 2. Accordingly, as shown in FIG. 2., a coil spring 8 has been provided therein with connection including shaft section **6*a* and, very similar to the connections 6 described above, either a screw thread connection 7 can be made with the handle 2 or a smooth cylindrical projection of reduced diameter, may project from the handle and be rigidly held to top portion 3 by laterally driven dowel pins (not shown). Instead, solid rubber may be used inside handle 2 to replace the coil spring 8**. Note that abnormal forces will bend the handle as shown in dot and dash lines thus preventing hand or thumb injuries during a fall.

Thus, during normal operation of the handle 2, by forcibly moving the handle downwardly to insert the bottom pointed end of the pole into the ground, neither spring 8 nor spring 5 will compress in a longitudinal direction. However, upon severe turning movements or unbalance of the skier causing him to bend the handle 2 with abnormal force, either or both springs 5 and 8 will flex sufficiently in a lateral direction to prevent permanent bending or breakage of the pole. Even upon possible breakage of either part 4 or 3, they may be detachably secured from the remainder of the pole easily and quickly, and replaced by a new part, thereby preventing the necessity of purchasing a new pole.

Summarizing, the spring in the grip will flex to prevent hand injury during a fall or other times when abnormal forces are applied and will return to its original configuration when the force is removed. The bending action of the handle will aid in the release of the hand from the grip or will help prevent hand injury even if the hand remains in the grip during the fall.

The spring in the shaft will flex during a fall when the skiers weight or other abnormal forces are applied perpendicular to the shaft and will return to its original configuration upon the removal of force thus preventing permanent bending or breaking of the pole.

Other flexible ski poles without a spring used in this manner will not stay rigid during normal skiing maneuvers and thus will not give adequate support needed for the maneuvers. Still other known ski poles will flex or deflect to prevent skier injury but will not return to their original configuration upon the removal of the applied abnormal force.

It should be noted that while two springs 5 and 8 are shown in the drawing, that the functioning of one spring is not dependent on the other and that they may be used together or separately. In some applications, for example, the central spring 5 would be sufficient. In other applications perhaps spring 8 alone is sufficient. In still other applications, both springs 5 and 8 may be desired together.

Thus, it will be seen that I have provided an efficient ski pole having one or more coil springs interconnecting parts of the pole and of such stiffness as to provide a rigid pole during normal operations but which will flex or bend laterally only upon abnormal bending forces applied to the handle by the skier.

While I have illustrated and described several embodiments of my invention, it will be understood that these are by way of illustration only and that various changes and modifications may be contemplated in my invention and within the scope of the following claims.

I claim:

1. A ski pole having an upper cylindrical portion and a lower cylindrical portion, a coil spring having ends, readily detachable means for detachably securing said ends to said upper and lower cylindrical portions, said coil spring being the sole interconnecting means between said detachable means and being of a diameter substantially that of said upper and lower cylindrical portions and of such stiffness as not to compress longitudinally during normal operations of the ski pole but which will bend in a lateral direction substantially beyond the normal outer limit of said upper cylindrical portion upon the application of an abnormal bending force on the ski pole.

2. A ski pole as cited in claim 1 together with a handle, a second coil spring detachably secured at its ends to the bottom of said handle and the top portion of said pole and of such stiffness as not to flex during normal bending forces applied to such handle.

3. A ski pole as recited in claim 1 together with a second coil spring concentrically mounted with respect to said spring and having ends connected to the ends of said spring.

4. A ski pole as recited in claim 1 wherein said readily detachable means comprises a threaded stud and an internally threaded collar.

* * * * *